US011528998B2

(12) United States Patent
Miller, Jr.

(10) Patent No.: US 11,528,998 B2
(45) Date of Patent: Dec. 20, 2022

(54) ADJUSTABLE MATTRESS WITH FOAM INSERTS AND AIR CHAMBERS

(71) Applicant: American National Manufacturing, Inc., Corona, CA (US)

(72) Inventor: Craig S. Miller, Jr., Corona, CA (US)

(73) Assignee: Number Bed Holdings, LLC, Lenexa, KS (US)

( * ) Notice: Subject to any disclaimer, the term of this patent is extended or adjusted under 35 U.S.C. 154(b) by 0 days.

(21) Appl. No.: 16/361,488

(22) Filed: Mar. 22, 2019

(65) Prior Publication Data

US 2019/0290016 A1 Sep. 26, 2019

Related U.S. Application Data

(60) Provisional application No. 62/646,721, filed on Mar. 22, 2018.

(51) Int. Cl.
*A47C 27/18* (2006.01)
*A47C 27/08* (2006.01)

(52) U.S. Cl.
CPC ..... *A47C 27/18* (2013.01); *A47C 27/082* (2013.01); *A47C 27/083* (2013.01)

(58) Field of Classification Search
CPC ..... A47C 27/082; A47C 27/083; A47C 27/10; A47C 27/18; A61G 7/05715; A61G 7/05776
See application file for complete search history.

(56) References Cited

U.S. PATENT DOCUMENTS 2,779,034 A 1/1957 Arpin
2,822,554 A 2/1958 Wenzelberger
3,315,559 A * 4/1967 Cohen ..... D04C 1/00 87/2
3,421,163 A 1/1969 Stoughton
(Continued)

FOREIGN PATENT DOCUMENTS

FR 2814653 A1 * 4/2002 ..... A47C 27/082

OTHER PUBLICATIONS

International Search Report and Written Opinion from International Application No. PCT/US2014/032971, dated Aug. 21, 2014, 11 pages.

*Primary Examiner* — David R Hare
*Assistant Examiner* — Alexis Felix Lopez
(74) *Attorney, Agent, or Firm* — Spencer Fane LLP

(57) ABSTRACT

A foam-air mattress includes a mattress housing including a top layer and a bottom layer; a plurality of pocket walls, disposed between the top layer and the bottom layer, air bladder inserts that can be inserted into the plurality of pocket walls, wherein the air bladder inserts are configured to be connected to a pumping system via a tubing assembly; and a plurality of foam compartments formed by the mattress housing and the plurality of pocket walls, configured to accept foam inserts. The air bladder inserts when inserted into the plurality of pocket walls and inflated by the pumping system, configure the plurality of pocket walls to expand and compress foam inserts disposed within the plurality of foam compartments so as to increase the density of the foam inserts. This arrangement has applications in both the consumer and medical airbed contexts, as well as in other support system contexts, such as seat cushions for chairs.

30 Claims, 15 Drawing Sheets

(56) References Cited

U.S. PATENT DOCUMENTS

| | | | | |
|---|---|---|---|---|
| 3,644,950 | A | 2/1972 | Lindsay, Jr. | |
| 4,025,974 | A | 5/1977 | Lea et al. | |
| 4,371,997 | A | 2/1983 | Mattson | |
| 4,389,742 | A | 6/1983 | DeWitt | |
| 4,411,033 | A | 10/1983 | Morgan | |
| 4,424,600 | A | 1/1984 | Callaway | |
| 4,435,864 | A | 3/1984 | Callaway | |
| 4,694,515 | A | 9/1987 | Rogers, Jr. | |
| 4,706,313 | A | 11/1987 | Murphy | |
| 4,803,744 | A | 2/1989 | Peck et al. | |
| 4,901,386 | A | 2/1990 | Lane | |
| 5,031,260 | A | 7/1991 | LaBianco | |
| 5,113,539 | A | 5/1992 | Strell | |
| 5,136,740 | A | 8/1992 | Kraft | |
| 5,235,713 | A | 8/1993 | Guthrie et al. | |
| 5,303,435 | A | 4/1994 | Haar et al. | |
| 5,329,656 | A | 7/1994 | Leggett | |
| 5,388,292 | A | 2/1995 | Stinson et al. | |
| 5,421,044 | A | 6/1995 | Steensen | |
| 5,630,237 | A | 5/1997 | Ku | |
| 5,634,225 | A | 6/1997 | Miller, Sr. et al. | |
| 5,675,855 | A | 10/1997 | Culp | |
| 5,699,570 | A | 12/1997 | Wilkinson et al. | |
| 6,098,223 | A | 8/2000 | Larson | |
| 6,122,785 | A | 9/2000 | Bondie et al. | |
| 6,212,718 | B1 | 4/2001 | Stolpmann et al. | |
| 6,219,868 | B1 | 4/2001 | Wang | |
| 6,223,369 | B1 | 5/2001 | Maier et al. | |
| 6,269,505 | B1 | 8/2001 | Wilkinson | |
| 6,302,988 | B1 | 10/2001 | Miller, Sr. et al. | |
| 6,684,433 | B2 | 2/2004 | Giori et al. | |
| 6,687,935 | B2 | 2/2004 | Reeder et al. | |
| 6,694,556 | B2 * | 2/2004 | Stolpmann | A47C 27/084 5/709 |
| 6,745,420 | B2 | 6/2004 | Giori et al. | |
| 6,826,795 | B2 | 12/2004 | Wilkinson | |
| 6,857,151 | B2 | 2/2005 | Jusiak et al. | |
| 6,922,863 | B2 | 8/2005 | Giori et al. | |
| 7,467,435 | B1 | 12/2008 | McKay et al. | |
| 9,271,579 | B2 * | 3/2016 | Riley | A47C 27/18 |
| 10,131,092 | B1 * | 11/2018 | Cook | A63G 31/12 |
| 2002/0133877 | A1 * | 9/2002 | Kuiper | A61G 7/001 5/81.1 R |
| 2002/0148045 | A1 | 10/2002 | Giori et al. | |
| 2002/0178503 | A1 | 12/2002 | Reeder et al. | |
| 2002/0189019 | A1 | 12/2002 | Schulte et al. | |
| 2003/0009830 | A1 | 1/2003 | Giori et al. | |
| 2003/0208849 | A1 * | 11/2003 | Wilkinson | A47C 27/084 5/713 |
| 2004/0064895 | A1 | 4/2004 | Hochschild et al. | |
| 2005/0125905 | A1 | 6/2005 | Wilkinson | |
| 2005/0273938 | A1 | 12/2005 | Metzger et al. | |
| 2006/0016003 | A1 | 1/2006 | Garrigues | |
| 2007/0186349 | A1 | 8/2007 | Lipman et al. | |
| 2008/0000029 | A1 | 1/2008 | Feingold et al. | |
| 2009/0136718 | A1 * | 5/2009 | Dacey | A47C 27/081 428/188 |
| 2011/0016634 | A1 | 1/2011 | Siegner et al. | |
| 2014/0208519 | A1 | 7/2014 | Balonick | |
| 2014/0298588 | A1 | 10/2014 | Riley et al. | |
| 2017/0318981 | A1 | 11/2017 | Duwell et al. | |

* cited by examiner

ADJUSTABLE MATTRESS WITH FOAM INSERTS AND AIR CHAMBERS

FIELD

The invention relates to adjustable sleep systems and more particularly to air adjustable sleep systems having interleaved air chambers and foam inserts.

BACKGROUND

Commercial airbeds have been growing steadily in popularity. Many types of airbeds have been developed for a variety of applications over the years, ranging from simple and inexpensive airbeds that are convenient for temporary use (such as for house guests and on camping trips), home-use airbeds that replace conventional mattresses in the home, to highly sophisticated medical airbeds with special applications (such as preventing bedsores for immobile patients). With respect to home-use and medical airbeds, more and more consumers are turning to these types of airbeds for the flexibility in firmness that they offer, allowing consumers to adjust their mattresses to best suit their preferences.

An airbed system typically includes an air mattress that is connectable to a pumping system for inflating one or more air chambers within the air mattress. The level of pressure of the air within the air chambers provides a user with a corresponding feeling of firmness. If the air mattress has different zones corresponding to different air chambers within the air mattress, different parts of the air mattress can have different levels of firmness.

Foam mattresses are another type of mattress popular with consumers. Consumers generally have a choice between different levels of firmness for foam mattresses. The firmness of foam is based on the type of foam, the density of the foam, and the Indention Load Deflection (ILD) rating associated with the foam. While foam mattresses generally cannot be adjusted in firmness, an adjustable air mattress is not functional unless filled with air. Further, resting on a multi-air chambered mattress does not provide sufficient flexibility between air chambers due to the generally rigid and inflexible connection processes required to obtain generally air tight chambers.

SUMMARY

Embodiments of the present invention provide an adjustable foam-air mattress where a user of the foam-air mattress is supported by foam, but is able to adjust the level of firmness of the foam on-the-fly as is possible with air mattresses. Thus, the present invention achieves a foam-air mattress where the user is able to experience the feeling of lying on and being supported by foam material, while providing the flexibility and adjustability of an air mattress.

In contrast to conventional foam-air mattresses where the user lies on a top layer of foam but in actuality is supported by one or more large air chambers below the top layer of foam, embodiments of the invention may utilize a foam-air configuration where the foam supports the user from the top of the mattress to the bottom of the mattress both when the air chambers are inflated and when the air chambers are deflated. When the air chambers are deflated, the user is supported entirely by the foam. As the air chambers are inflated, the foam supporting the user is compressed to provide additional firmness, and some of the weight of the user is supported in part by the inflated air chambers as well.

In one exemplary embodiment, this is achieved by configuring the air-foam mattress such that it contains a plurality of compartments that accept rectangular-shaped foam log inserts, with the sidewalls of the compartment being air chambers. The term "plurality of compartments" is used interchangeably with the term "plurality of foam compartments" throughout this application. The top and bottom layers of the mattress hold the air chamber sidewalls in place, and the air chamber sidewalls traverse the mattress horizontally from side-to-side. Foam logs are inserted into the air mattress in the compartments formed by the air chamber sidewalls and the top and bottom layers of the mattress. Thus, when the user lies on the mattress, the user is lying on foam from the top of the mattress to the bottom of the mattress. Inflation of the air chambers compresses the foam inserts so as to increase the density of the foam and give the foam a firmer feeling, as well as provide additional support to the user from the inflated air chambers.

In a further exemplary embodiment, the mattress housing is open-ended such that the foam logs can be readily inserted and removed from the mattress. This allows for customization of the feel of the mattress even after a consumer purchases the mattress, for example, by swapping firmer foam inserts with softer foam inserts, or by setting up zones of relatively firmer or relatively softer foam inserts within the mattress. Different shapes of foam inserts could also be used.

In another exemplary embodiment, an air-foam mattress includes a mattress firmness control housing receiving and relatively positioning air chambers and foam inserts. The housing contains a plurality of foam compartments that accept rectangular-shaped foam log inserts, with sidewalls or pocket sidewalls of the foam compartments also forming air chamber compartments between the foam compartments. The top and bottom layers of the housing hold the pocket sidewalls in place, and the pocket sidewalls traverse the mattress horizontally from side-to-side. Foam logs are inserted into the air mattress in the foam compartments formed by the pocket sidewalls and the top and bottom layers of the mattress. Thus, when the user lies on the mattress, the user is lying on foam from the top of the mattress to the bottom of the mattress. Inflatable air bladder inserts are inserted between the pocket sidewalls. Inflation of the inserted air bladders expand the air chambers and force the pocket sidewalls apart compressing the foam inserts, to increase the density of the foam and give the foam a firmer feeling, as well as provide additional support to the user from the inflated air bladder inserts.

BRIEF DESCRIPTION OF THE SEVERAL VIEWS OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings.

FIG. 14(*b*) is an enlarged schematic diagram illustrating a close up front, assembled view of the foam-air mattress from area A depicted in FIG. 13.

FIG. 15(*b*) is a schematic diagram illustrating a close-up front, assembled view of the foam-air mattress from Area A depicted in FIG. 13 in operation with air chamber inserts inflated, pocket walls forced apart, and foam inserts compressed.

DETAILED DESCRIPTION

Figure 1:
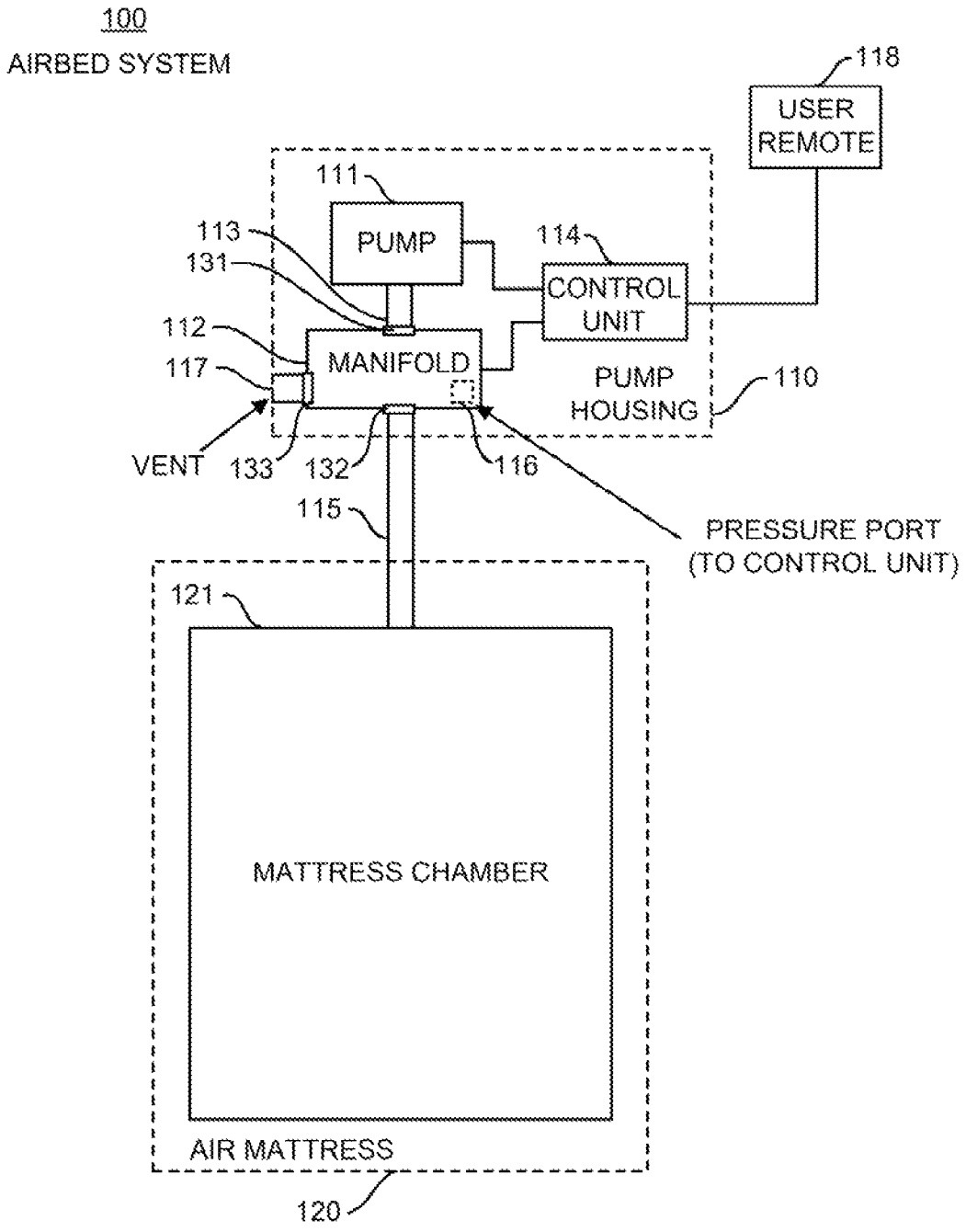
FIG. 1 is a block diagram illustrating an airbed environment useable in embodiments of the described principles.

An exemplary environment in which the invention may operate is described hereinafter. It will be appreciated that the described environment is an example, and does not imply any limitation regarding the use of other environments to practice the invention. With reference to FIG. 1 there is shown an example of an airbed system 100 that may be used with the present method and system and generally includes a pump housing 110 having a pump 111, manifold 112 and control unit 114, and an air mattress 120 having at least one mattress chamber 121. It should be appreciated that the overall architecture, as well as the individual components of a system such as that shown here are generally known in the art.

The pump 111 may be any type of pump suitable for pumping air into an air mattress, including but not limited to squirrel-cage blowers and diaphragm pumps. The pump 111 is connected to the manifold 112 via a connection tube 113 with a valve 131 positioned at the connection of the tube 113 and the manifold 112. It will be appreciated that in other embodiments, the pump 111 may be directly connected to the manifold 112 without a connection tube 113 and that the valve 131 may be positioned at any appropriate place between the pump outlet and the manifold chamber. The manifold 112 may be a conventional manifold with a manifold chamber with appropriate connections to a vent 117, the outlet of the pump 111, and the air mattress chamber 121. The manifold 112 includes a pressure port or static tap 116 leading to a pressure sensor on the control unit for measuring pressure (e.g. a 1.45 psi RoHS-compliant pressure sensor). The manifold 112 further includes a valve 133 leading to the vent 117 (the vent may be a connection tube or merely an opening connecting the manifold chamber to atmosphere) and another valve 132 leading to a connection tube 115 and mattress chamber 121 within the air mattress 120.

The control unit 114 communicates with the pump 111, valves 131, 132 and 133, the pressure sensor 116, and the user remote 118 to control the deflate and inflate operations of the airbed system. Specifically, the control unit 114 may open and close the valves, turn the pump on and off, receive pressure readings from the pressure sensor 116, receive user input from the user remote 118, and cause information to be displayed on a display on the user remote 118. The user remote 118 preferably includes a display that is capable of displaying a target pressure input by the user, the actual pressure within the chamber (as obtained through a previous or new static measurement), and/or other relevant information to the user, as well as "up" and "down" buttons for the user to adjust a target pressure (and additional zone selection buttons for systems where the air mattress has more than one mattress chamber). It will be appreciated that other methods of user input may be used, such as having a number pad, slider, or dial. The control unit 114 may further be configured with advanced algorithms for determining static pressure from dynamic pressure measurements and simulating inflation or deflation in certain circumstances. It will be appreciated that the connection between control unit 114 and the user remote 118 may be a wired connection or a wireless connection.

The control unit 114 includes a processor (e.g. an 8-bit PIC16F88 microcontroller) and a tangible non-transient computer-readable medium (e.g., RAM, ROM, PROM, volatile, nonvolatile, or other electronic memory mechanism) with instructions stored thereon. It will be appreciated by one skilled in the art that the execution of the various machine-implemented processes and steps described herein may occur via the execution of computer-executable instructions stored on the computer-readable medium. Thus, for example, the operation of the pump and the opening and closing of valves during inflate and deflate operations may be executed according to stored applications or instructions at the memory of the control unit 114.

While the system 100 depicted by FIG. 1 shows an air mattress 120 having only one mattress chamber 121, it will be appreciated that the principles described herein may be applied to other environments, including airbed systems having multiple mattress chambers and multiple zones for which inflation and deflation may be independently controlled. For example, by having separate connections from the manifold and the control unit to head, torso, and feet zones of a three-zone air mattress, one or more air chambers associated with each zone may be independently inflated and/or deflated. In another alternative environment, the control unit 114 may be integrated with the remote 118.

Figure 2:
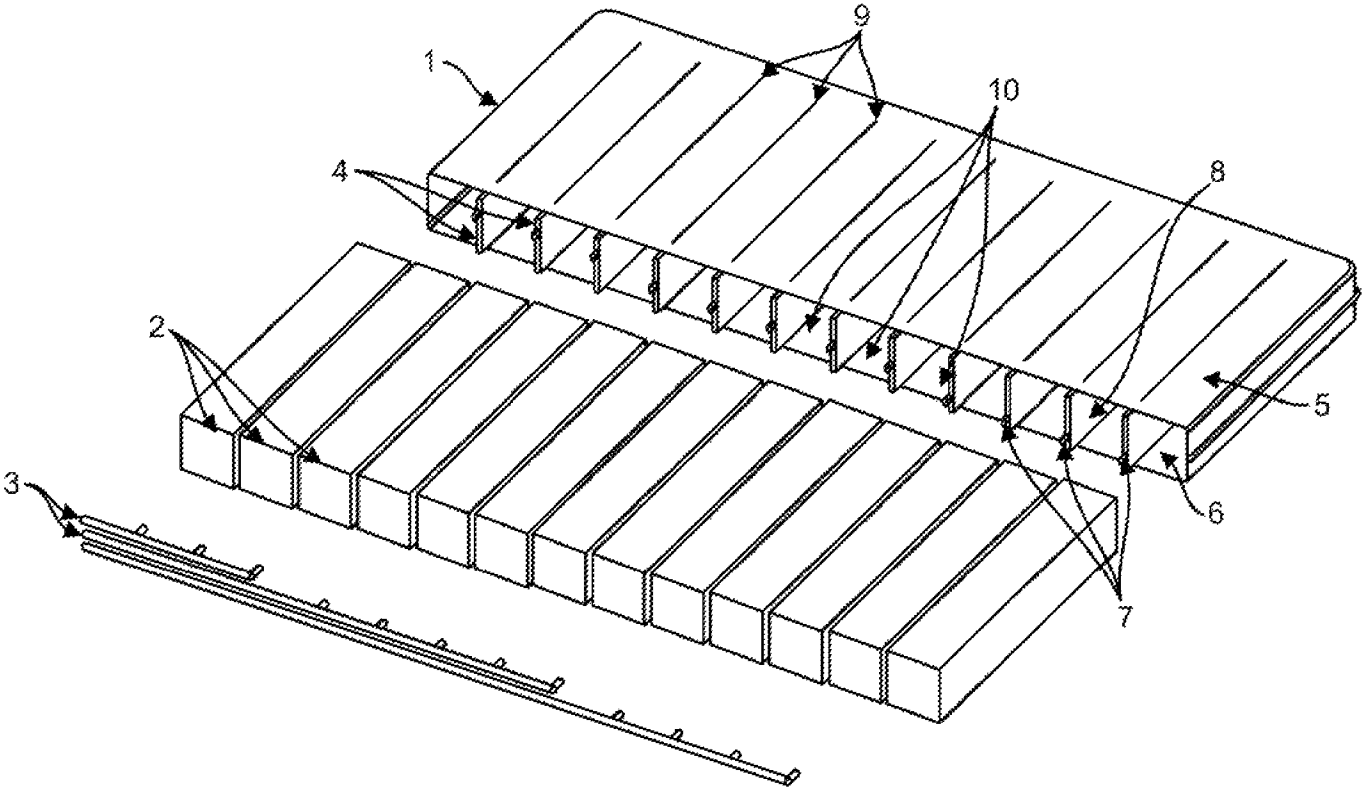
FIG. 2 is a schematic diagram illustrating an expanded view of a foam-air mattress in one exemplary embodiment.

An expanded view of an adjustable foam-air mattress (1) according to an exemplary embodiment of the invention is depicted in FIG. 2. The adjustable foam-air mattress is comprised of three basic parts, inflatable air chambers (4) which act as sidewalls for the compartments formed in the foam-air mattress, foam inserts (2) which in this example are rectangular foam logs, and tubing assemblies (3) that connect the inflatable air chambers to the pumping system.

In an example, the housing of the foam-air mattress (1), which includes a top layer (5) and a bottom layer (6), and the inflatable air chambers (4) are made from either urethane, PVC, coated fabric capable of air holding, or other suitable materials (e.g., poly-nylon, poly film laminates, rubber construction, etc.). The inflatable air chambers (4) are held in place relative to each other by the top layer (5) and bottom layer (6), for example through welding or other types of attachment. Each inflatable air chamber (4) is air holding and has an entry valve (7) which is used to inflate the pod. In one example, the entry valves (7) are positioned at one end of the inflatable air chambers (4) as depicted. In another example (not depicted), the entry valves are located on the larger face of the air chambers (8) and have a 90-degree bend to allow connection to the tubing assemblies (3). The tubing assemblies (3) are connected to the entry valves (7) and bring a working fluid (e.g., air) from a pumping system (e.g., as shown in FIG. 1) to inflate the air chambers and compress the foam inserts (2), thus changing the density and corresponding feeling associated with the foam. The entry valve (7) may, for example, be an air-holding valve (such as a colder female fitting) or a non-air-holding connector. It will be appreciated that air need not necessarily be used, as other gases or fluids could be used as well.

The top layer (5), which is attached to the air chambers (4), provides a surface upon which other components, such as foam toppers and covers, may be placed or attached. In certain implementations, the top layer (5) itself includes such components. Similarly, the bottom layer (6) provides a surface that allows the foam-air mattress to be placed or attached to other components, such as a box-spring base. In certain implementations the bottom layer (6) itself includes such components, such as springs or further air chambers.

The foam inserts (2), which are slipped into the compartments (10) formed by the air chambers (4) and the top (5) and bottom (6) layers of the housing may be comprised by various types of foam in various embodiments. Variations of density, ILD, and material type (PU/Visco/Latex) provide an almost limitless matrix of comfort solutions depending upon the designer's desired goal. In one example, all of the foam inserts (2) could use the same material and have the same properties. In another example, different foam types and foam inserts having different densities could be used in different zones of the mattress (for example, one type of foam for the head zone, another type for the torso zone, and yet another type for the feet zone). Given the open-ended design of the mattress, the foam inserts are readily removable and replaceable with other foam inserts, providing a great degree of flexibility and customization with respect to the feel of the foam-air mattress.

Figure 3:
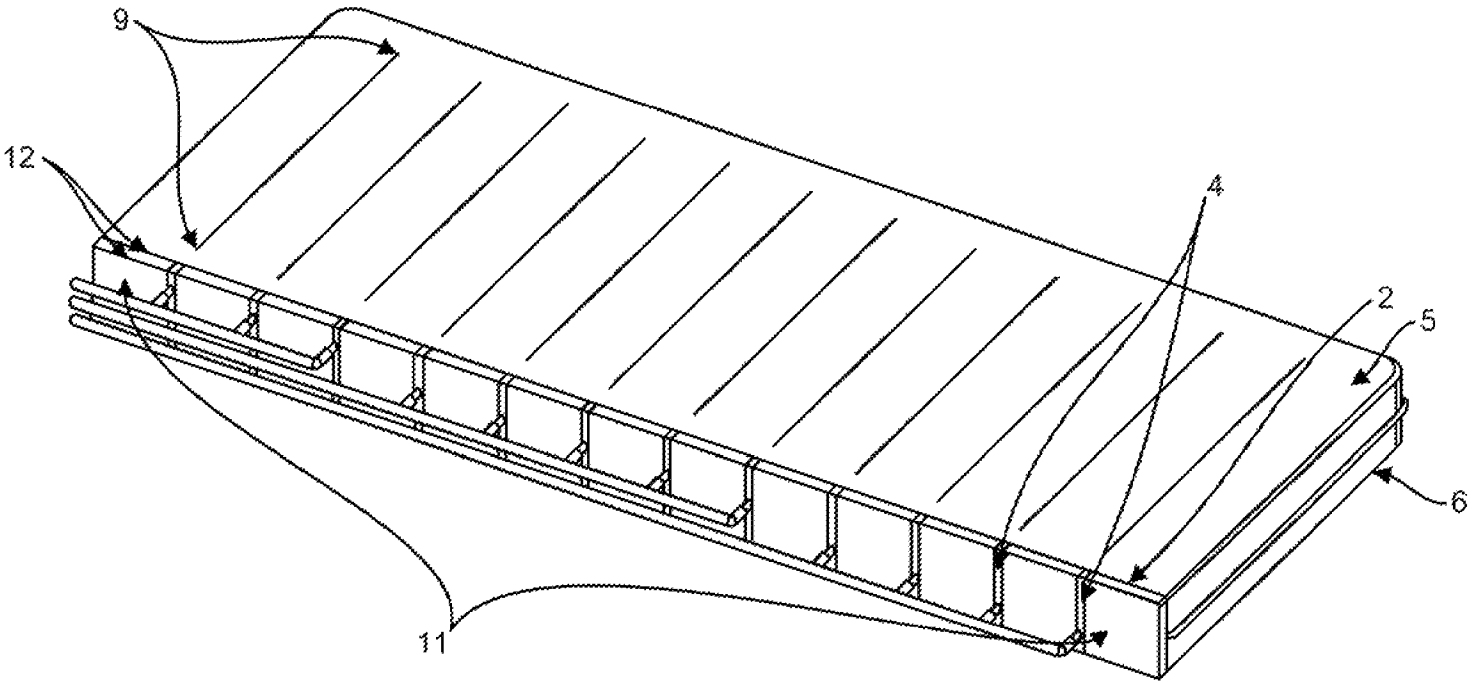
FIG. 3 is a schematic diagram illustrating a front, assembled view of the foam-air mattress depicted in FIG. 2.
Figure 4:
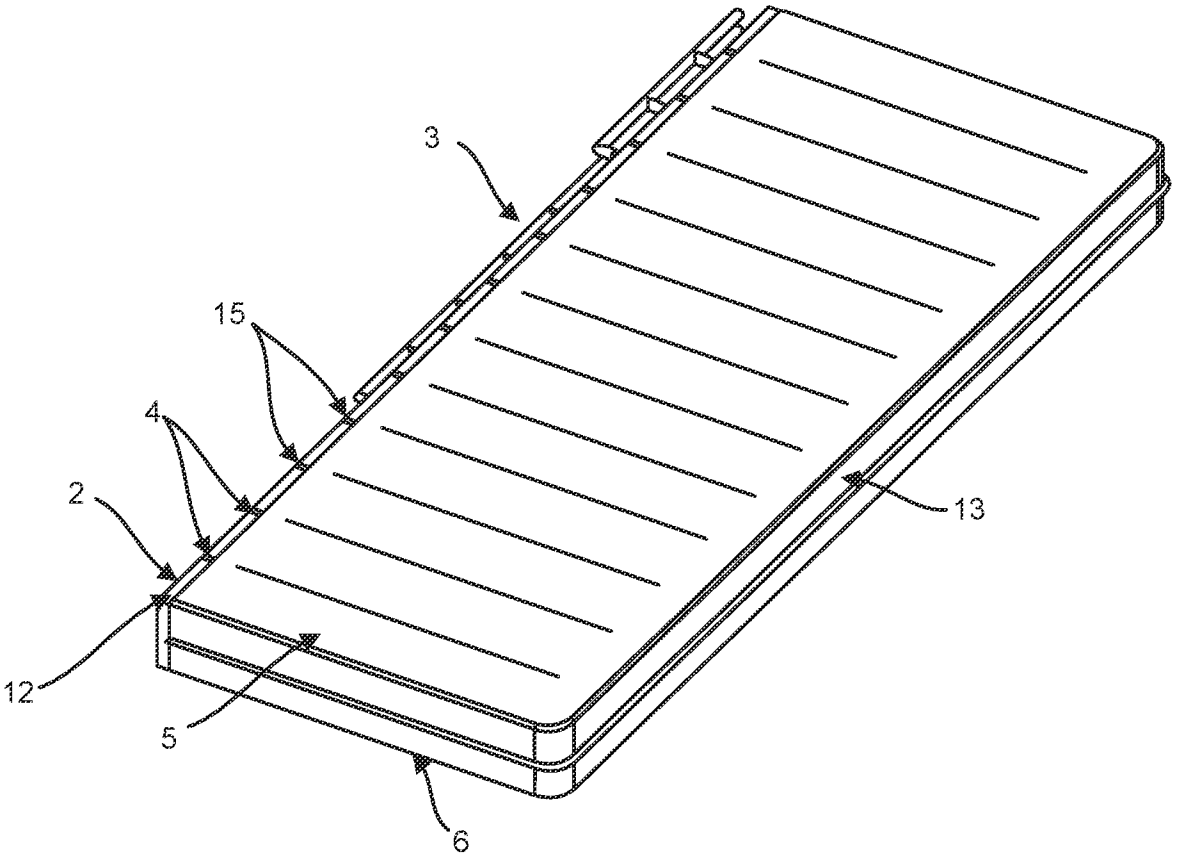
FIG. 4 is a schematic diagram illustrating a back, assembled view of the foam-air mattress depicted in FIG. 2.

FIGS. 3 and 4 depict this same foam-air mattress in assembled views from different angles. As can be seen from FIGS. 2 and 3, the top (5) and bottom (6) layers are further connected on three sides of the foam-air mattress by walls of the mattress housing. The walls at opposing ends of the foam-air mattress form contribute to forming the two compartments (11) for foam inserts at the two ends of the foam-air mattress.

This exemplary embodiment includes an open end for the foam-air mattress (shown in the front of FIG. 3) where the foam inserts are inserted. The opposite/back side (13) is closed (e.g., by welding), so that the compartments for the foam inserts are encapsulated on five sides (e.g., two air chamber sidewalls, the top and bottom layers of the mattress housing, and the opposite/back side (13)). In the depicted embodiment, the positioning of the tubing assemblies (3) serves to retain the foam logs with respect to the open end. In an alternative embodiment, the tubing assemblies (3) are connected to the opposite/back side (13) through apertures in the opposite/back side (13). This allows for easy removal/insertion of the foam inserts (2) without having to remove the tubing assemblies (3), while having compartments that are encapsulated on five sides. In yet another alternative embodiment, the opposite/back side is left open, and the foam inserts can be longer than the width of the mattress housing so as to extend outwards on both sides (in this case the foam inserts would only be encapsulated on four sides). In yet another alternative embodiment, the mattress is closed such that all foam inserts are encapsulated on all six sides.

In other embodiments, valves and their corresponding tubing assemblies may be placed on multiple sides of the mattress, or even plumbed through the interior of the mattress. In such embodiments, entry valves (7) may protrude from the sides, top, and/or bottom of the mattress housing, whether closed or open-ended, as appropriate.

Although the foam inserts (2) as depicted in FIGS. 2-4 are shown to match the compartment size such that the foam inserts are flush with the air chambers (4) (15), this is not a requirement. The foam inserts may be uniform or may have varying widths, lengths and heights, depending on the performance requirements for the mattress and/or the needs of users. Differently-sized foam inserts (such as foam inserts that are either proud or recessed relative to either the edge (12) of the top (5) and bottom (6) layers or the air chambers (4) (15)), as well as differently-shaped foam inserts (such as round or triangularly-shaped inserts) may be used. In certain embodiments, a mix of foam inserts having various densities and/or various shapes and dimensions may be inserted in a single foam-air mattress. Further, it will be appreciated that the foam inserts (2), as well as the foam-air mattress itself, may have any desired width, length and height dimensions.

In an embodiment, the foam inserts are "press fit" such that the foam dimensions are larger than the dimensions of the compartment to which it is to be inserted. Being "press fit" provides a relatively more immediate and pronounced impact on the foam when the adjacent air chambers are inflated. Conversely, in another embodiment, the foam inserts may be smaller than the compartments to allow for easier assembly and a reduced impact of compression on the foam. In yet another embodiment, the dimensions of the foam inserts and the opening of the compartments are matched so as to have the same dimensions.

In the depicted embodiment, the inflatable air chambers (4) extend beyond the edge (12) of the top (5) and bottom (6) layers of the mattress housing, and welding is used to attach the inflatable air chambers to the top (5) and bottom (6) layers of the mattress housing. The extension of the air chambers beyond the edge (12) allows for a streamlined welding process. It is further noted that, in this example, the welds (9) on the top (5) and bottom (6) layers stop well before the edge (12).

Figure 5:
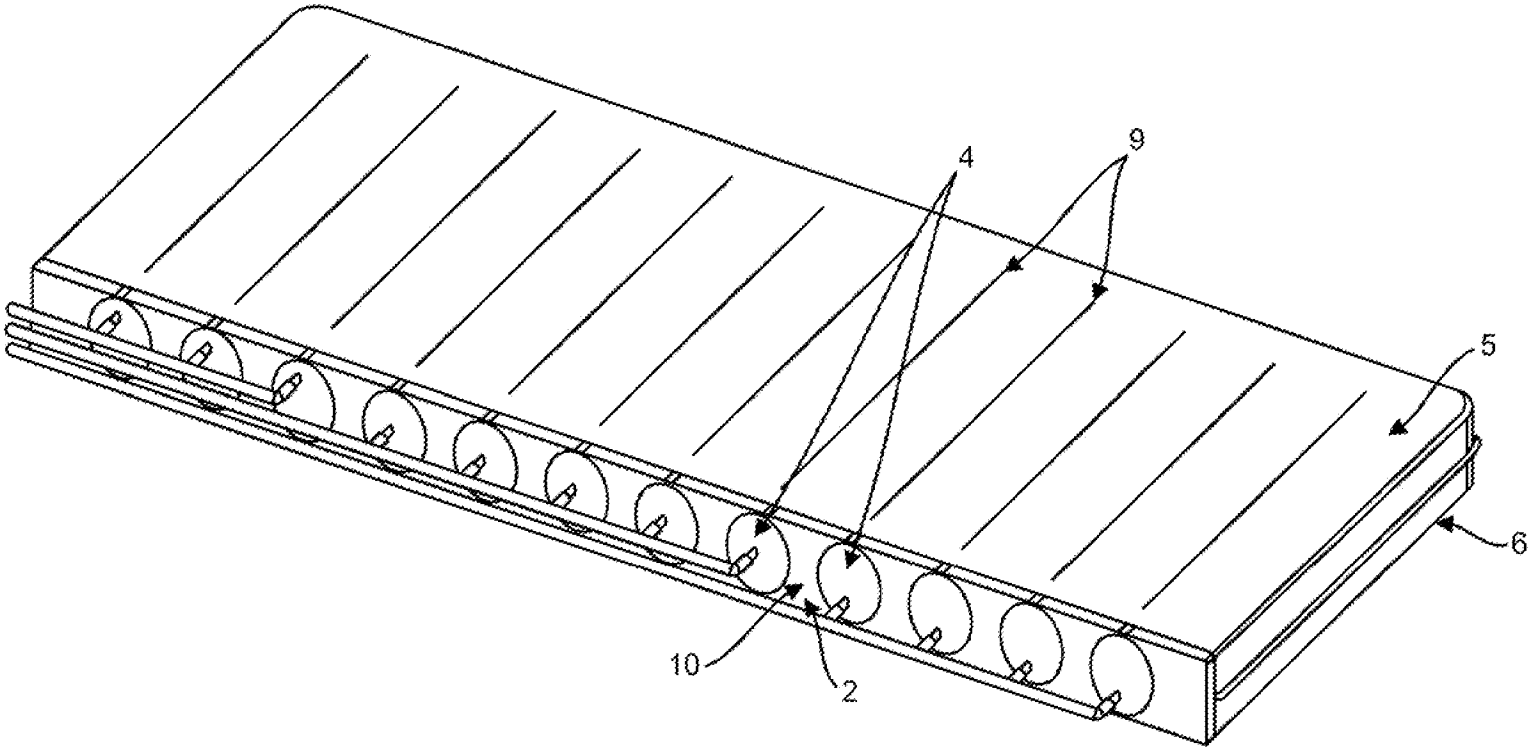
FIG. 5 is a schematic diagram illustrating a front, assembled view of the foam-air mattress depicted in FIG. 2 in operation with air chambers inflated.

In FIGS. 2-4, the depicted foam-air mattress is shown with the air chambers (4) in an uninflated state. FIG. 5 illustrates the same foam-air mattress with the air chambers (4) inflated. Increasing the pressure inside the air chambers (4) increases their volume and, because they are restrained by weld (9) between the top (5) and bottom (6) layers of the mattress housing, reduces the volume of compartments (10) between them, thus compressing the foam inserts (2) and increasing the density of the foam. In this example, the air chambers (4) have all been inflated to a uniform pressure.

In further embodiments, the configuration of the air chambers (4) themselves can also be engineered to provide variations of the support provided to a user (in addition to the variability of support achieved by variation of foam insert (2) density). In one example, as will be discussed in further detail below, the air chambers (4) have a figure eight shape to provide a different profile of compression to the foam inserts (2). In another example, the air chambers (4) can be shaped so as to lift or retract the foam when the air chambers (4) are inflated, so as to give different surface features to the mattress (such as a domed or curved section that rises up from the top layer of the mattress).

Thus, it will be appreciated that embodiments of the present invention provide for integration of air chambers and foam in a mattress utilizing a structure that allows for exerting pressure on multiple sides of multiple foam inserts (e.g., on two sides of a rectangular log-shaped foam insert) to compress the foam and customize the corresponding "feel" of the foam. The pressure on the foam inserts is exerted by air chambers and/or static components (e.g., the top and bottom layers of the mattress housing). When the air chambers are completely uninflated, the foam-air mattress is at its softest, most plush state. As one or more air chambers are inflated, the foam becomes compressed and the feel of the mattress becomes firmer.

Figure 6:
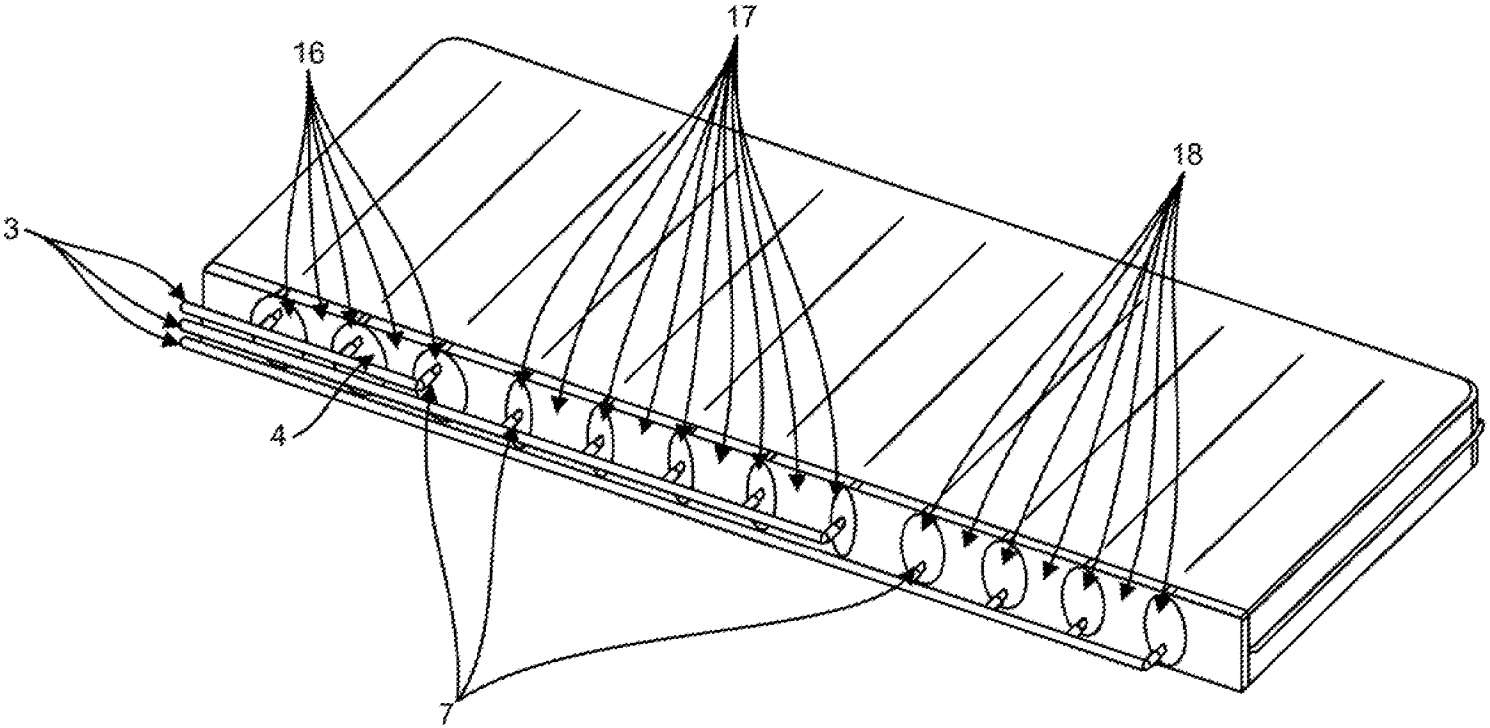
FIG. 6 is a schematic diagram illustrating a foam-air mattress having multiple zones in another exemplary embodiment.

FIG. 6 illustrates a further exemplary embodiment of the invention where a foam-air mattress is divided into different zones having independently controllable air chambers (4). In the example shown in FIG. 6, the three air chambers on the left side of the figure correspond to a "Head" zone (16) and are relatively the most inflated, the five air chambers in the middle of the figure correspond to a "Torso" zone (17) and are relatively the least inflated, and the four air chambers on the right side of the figure correspond to a "Foot" zone (18) and are relatively moderately inflated. Thus, a user controlling a pump for the foam-air mattress will be able to separately control the feel of the foam in each of these zones. In certain embodiments, the zones may be plumbed such that more than one zone operates simultaneously based on a single pump action (e.g., head and foot zones can be plumbed together in an exemplary embodiment with the torso zone being plumbed separately).

Further, it will be appreciated that the tubing assembly for each zone may be configured to facilitate equalization of pressure in the air chambers corresponding to that zone. For example, by keeping the entry point valves open for a particular zone (or by omitting the entry point valves and placing one or more zone-based valves farther upstream in the tubing assembly), a group of air chambers may be inflated or deflated simultaneously. Grouping the air chambers in this manner and leaving an open connection between them also allows for equalization of pressure when pressure changes occur (for example, as caused by outside forces such as shifting of a weight on the mattress). In certain embodiments, one zone can be inflated while another zone is simultaneously deflated (based upon the configuration of the manifold and pumping system).

As depicted in FIG. 6, the air chambers (4) corresponding to each zone has a separate tube assembly (3) connecting the air chambers back to a pumping source. In this example, varying the height at which the valves (7) are welded to the air chambers (4) with respect to each group allows for an organized and orderly configuration of the tubing assemblies (3). However, it will be appreciated that a similar result may be accomplished without grouping the tubing assemblies as shown, for example, by having each air chamber (4) connected individually to a manifold, and controlling valves corresponding to each of the individual tubes in a grouped fashion using control logic implemented by a pump control unit.

When a foam insert is at or near the border between separately controlled zones, the impact of the air chambers of one zone being inflated to a different pressure than the air chambers of an adjacent zone is smoothed over the transition between the two zones, as the foam insert between two air chambers having different pressure levels will experience a relatively larger deflection from one side than the other. Thus, that foam insert between the two zones is compressed to a median density that is between the density of the foam inserts on either side of it. It will be appreciated that different levels of sophistication with respect to the pump and control logic for the pump may be utilized based on the specific needs of particular embodiments (e.g., to accommodate different numbers of separately-controllable zones, tubing assemblies, air chambers, etc.).

Figure 7:
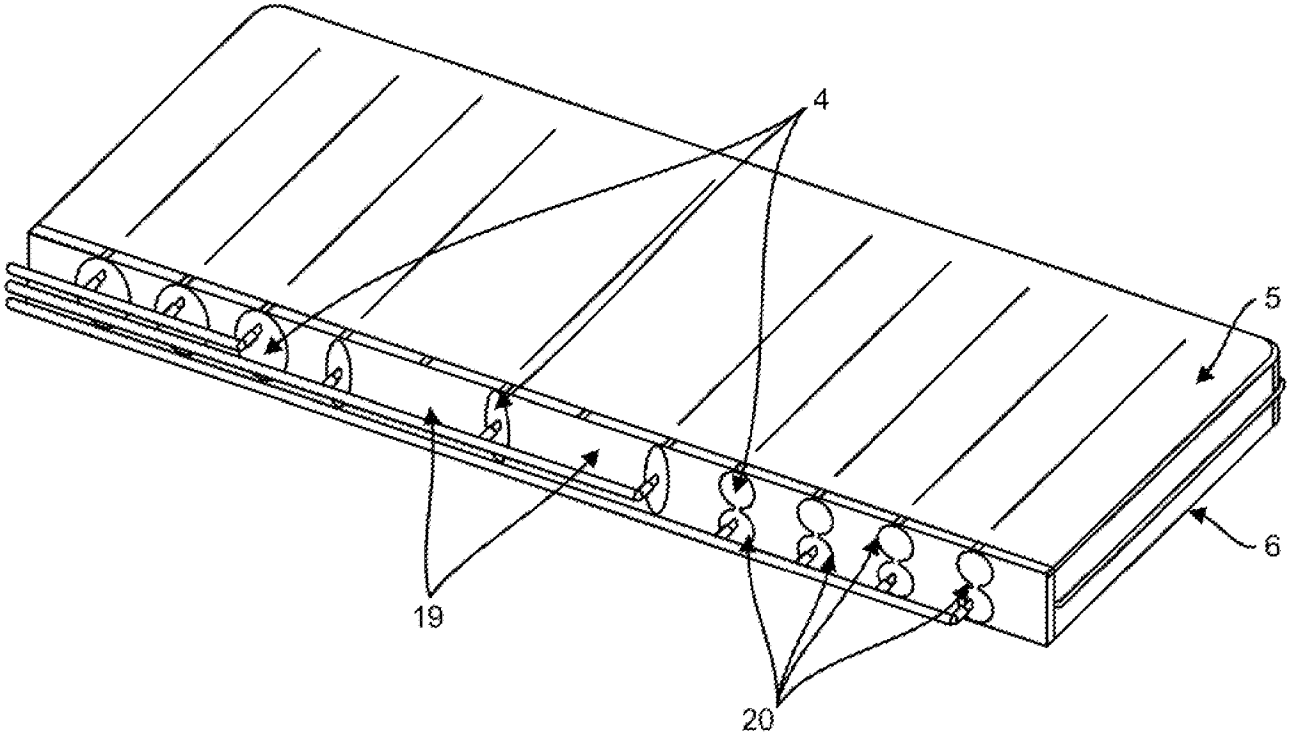
FIG. 7 is a schematic diagram illustrating multiple zones, non-uniform spacing of air chambers, and alternate air chamber configurations in a foam-air mattress.

FIG. 7 illustrates further aspects of the foam-air mattress that may be varied to provide different configurations suitable for various applications. For example, the spacing (19) between the air chambers (4) can thus be modified to tailor a range of "feels" for the sleeping surface. In certain applications it may be desirable to use wider foam inserts for one part of the mattress and narrower foam inserts for other parts of the mattress, or to have certain air chambers spaced farther apart such that the foam insert between those air chambers are compressed relatively less than the foam inserts disposed between other air chambers spaced closer together.

The profile (or cross-section) (20) of the air chambers (4) may also be modified to provide different effects. In FIG. 7, the four air chambers on the right side of the figure, when inflated, take on a figure eight shape to provide a relatively more uniform compression of the foam from top to bottom. For example, the figure eight shape may be achieved by designing the air chambers such that each air chamber includes a top and bottom interior chamber. Both interior chambers may be inflated via a single valve or two independent vales. It will be appreciated that more than two interior chambers may be used to further increase uniformity of the application of pressure. Alternatively, a similar design could be implemented using two (or more) separate air chambers with separate valves and tubing for each chamber.

In other further embodiments, the profile (20) of the air chambers (4) down the length of the air chambers (4) may be non-uniform, so as to provide a density gradient from side-to-side of the mattress by varying the amount of air support/foam compression. This would allow for configuration of a horizontal firmness gradient in combination with a vertical firmness gradient defined by the different zones and controlled by the user. In another further embodiment, this same concept is used to create a bulge at both ends of the air chambers (4) which serves to retain the foam logs within their compartments without closing off the lateral sides of the mattress.

In further embodiments, certain zones of a foam-air mattress may be entirely comprised of foam (or may rely entirely on an air chamber). For example, if no adjustment of a "foot" zone is needed, the part of the mattress corresponding to the foot zone may be solid foam without any air chambers, while other zones of the mattress contain air chambers with compartments for foam inserts to provide firmness adjustments. Alternatively, in other embodiments, zones relying on a conventional air chamber as the supporting element may be integrated with other zones utilizing compartments for foam inserts with air chambers as sidewalls.

In further embodiments, the mattress housing, foam inserts and air chambers (when uninflated and/or when inflated) may include variations in height.

In further embodiments, the top and/or bottom layers of the mattress housing also include air-holding chambers. For example, air chambers disposed in the top and bottom layers in particular zones may be used to adjust the height of the mattress in those particular zones or to provide extra air support in those zones. In another example, the compartments containing the foam inserts have a bottom air chamber floor in addition to two air chamber sidewalls, while the top layer is still the static top layer of the air mattress housing shown in FIG. 2. This configuration provides for further compression of the foam inserts from an additional side encapsulating the foam inserts. Additionally, the exterior walls of the mattress housing that connect the top and bottom sheets (to the extent that the mattress housing has any exterior walls), may be comprised of air chambers in part or in whole, and/or may be comprised of walls that are not configured to hold air.

In further embodiments, interior walls within the mattress housing (which are the air chambers (4) depicted in FIG. 2), may include both air chambers (4) and non-air chamber components. For example, the mattress may include a plurality of compartments for inserting foam inserts, but only certain of those compartments have one or more air chamber walls. This provides certain advantages that allows for a standard foam insert to be used in various foam-air mattress applications (some of which may require relatively less interior air chamber partitions). In other further embodiments, each individual interior wall may be comprised of both air chamber parts and non-air chamber parts. For example, the air chamber may be smaller than the height of the interior of the mattress housing, and each interior partition includes an air chamber in addition to a wall component extending from the air chamber to the top and/or bottom layers of the mattress housing.

In the embodiments depicted by FIGS. 2-7, the air chambers are all parallel to one another and run along a side-to-side orientation. In other embodiments, the air chambers may have other angles and orientations to achieve different types of customizability. For example, in one embodiment, a particular zone may have air chambers that run in a head-to-toe orientation rather than in the side-to-side orientation (e.g., to facilitate rolling a person lying on the bed or to provide a different feel). In another embodiment, the air chambers may be oriented at some angle that is in neither the head-to-toe orientation nor the side-to-side orientation.

Figure 8:
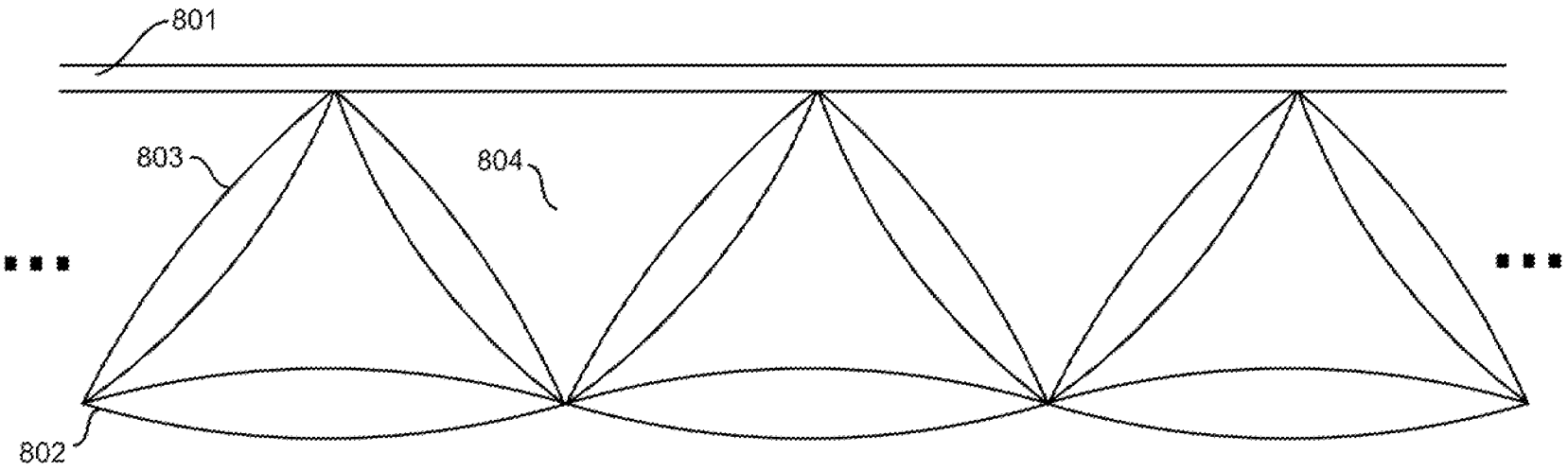
FIG. 8 is a schematic diagram illustrating part of a cross-section of a foam-air mattress in yet another exemplary embodiment.

FIG. 8 depicts part of a cross-section of a foam-air mattress in an alternative embodiment of the invention that utilizes some of the alternative features discussed above. The foam-air mattress of FIG. 8 includes a top layer 801 (that does not include any air chambers), a bottom layer 802 (that includes a plurality of air chambers serving as walls for the compartments), a plurality of air chambers 803 disposed between the top and bottom layers, and a plurality of compartments 804 formed by the air chambers 803 and the air chambers in the bottom layer 802 configured to accept triangularly-shaped foam inserts. The air chambers of the bottom layer may be connected to a tubing assembly such that they are inflated and deflated independently and/or in a zone-based manner. The embodiment depicted in FIG. 8 thus provides a different configuration of the compartments where some compartments are completely encapsulated by air chambers and others are encapsulated on two walls by air chambers and on one wall by the non-air chamber top layer, and where the air chambers disposed between the top and bottom layers are not all parallel to one another. This configuration allows for a greater degree of air support from the air chambers in the bottom layer when those chambers are inflated, and provides for yet another manner of modifying the firmness and "feel" of a foam-air mattress. It will be appreciated that FIG. 8 is merely illustrative of one exemplary alternative embodiment, and that other variations are contemplated as well.

It is noted that inflated the air chambers within the foam-air mattress places stress on the connections between the air chambers and the mattress housing, for example, where the air chambers are attached to top and bottom layers of the mattress housing. In an embodiment, the end seals of the air chambers are oriented to be planar with the welds at the top and bottom layers. This further allows for use of a wider top and bottom layer for the mattress housing to further reduce stress on these components. Further, an extra strip of material may be added between the mattress housing layer and the air chamber when welding to further strengthen the attachment. In one embodiment, the welds are extended past the edge of the top and bottom layers of the mattress housing but terminate before the end of the air chambers and the strip of extra material (the air chambers extend beyond the edges of the top and bottom layers of the mattress housing in this embodiment). Additionally, a tear drop shape is used at the termination of the welds to increase the weld area around the termination (where stress is concentrated). This overall welding configuration allows for shifting of the stress points from within the mattress housing at least partially to an area outside the mattress housing where less load is present.

Figure 9:
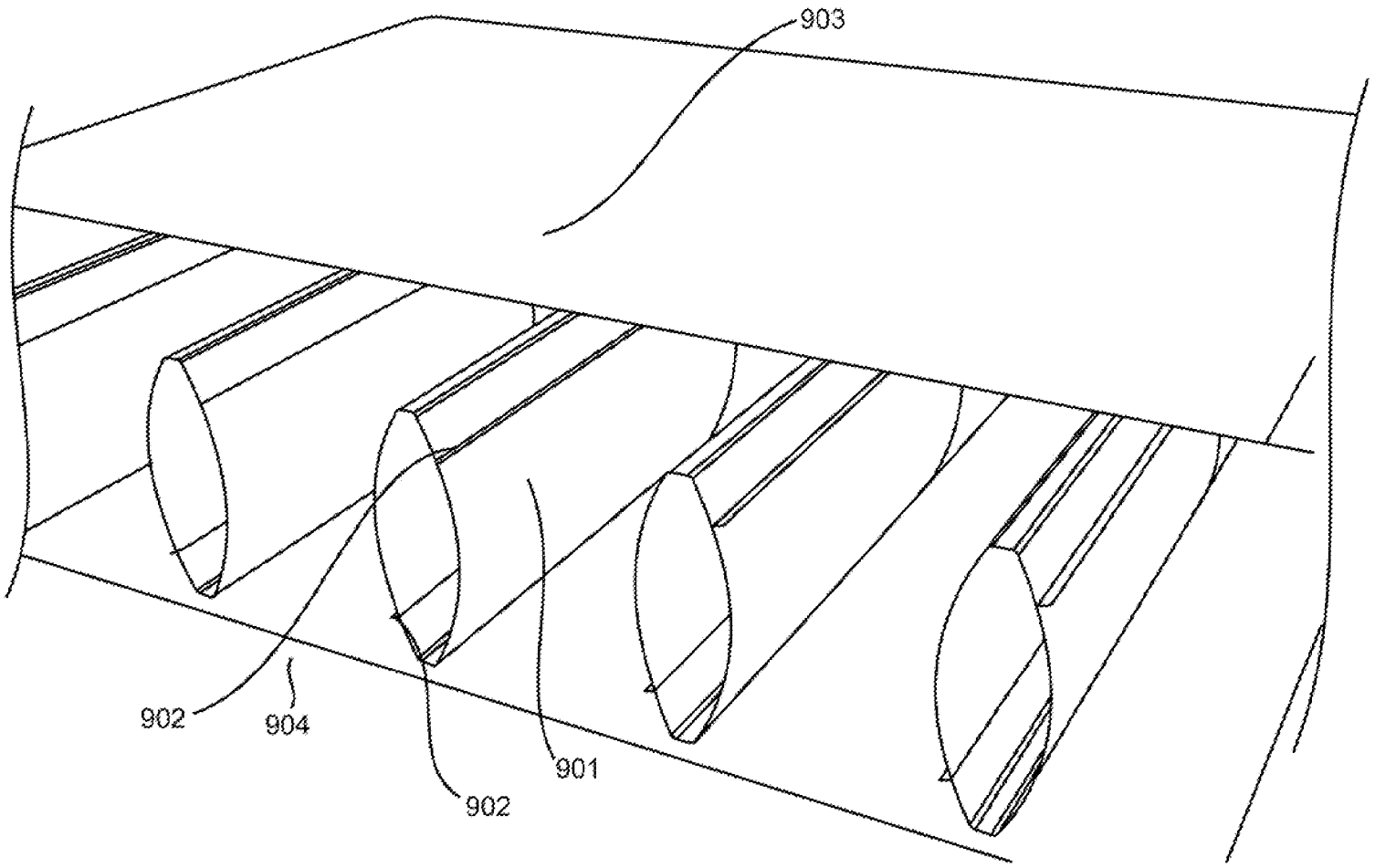
FIGS. 9-10 are schematic diagrams showing views of the components of an exemplary foam-air mattress to illustrate an exemplary welding process.
Figure 10:
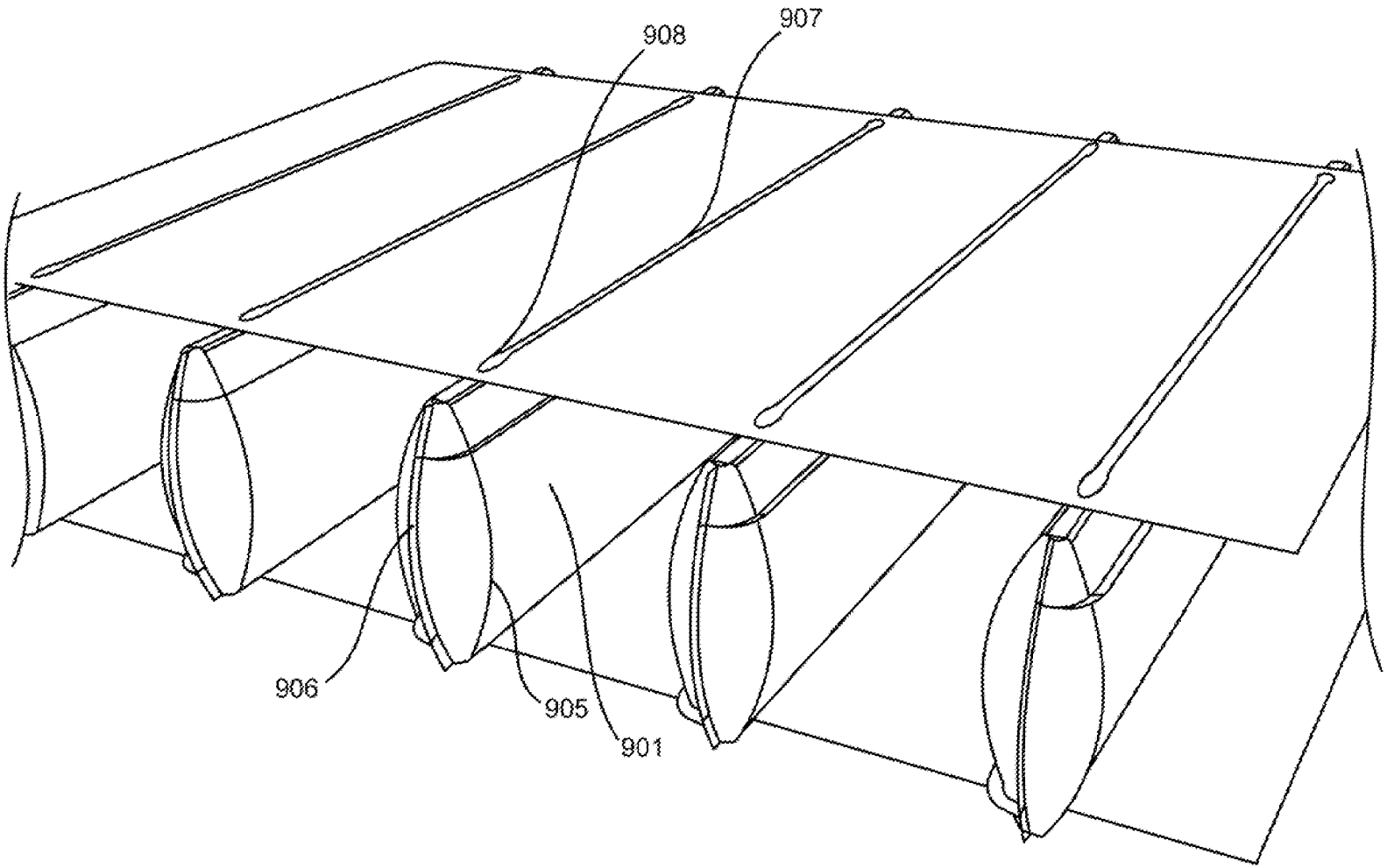

FIGS. 9-10 are schematic diagrams showing views of the components of an exemplary foam-air mattress to illustrate an exemplary welding process in greater detail. In FIG. 9, the longitudinal air chamber 901 is shown as two flat sheets that are welded together on a long edge at two places. The two welds 902 have a "clocking" configuration that is achieved by controlling the location of the welds attaching the top layer 903 to the air chamber and the bottom layer 904 to the air chamber. The "clocking" configuration prevents the edge welds from meeting when the end of the air chamber is sealed and allows for location of an inlet valve (not pictured) in the center of the air chamber face. Because the two ends of the air chamber 901 are open-ended at this point, this configuration allows for insertion of a welding bar used to attach the top and bottom of the air chamber to the top layer 903 and bottom layer 904 via welding, and removal of the welding bar after the attachment.

FIG. 10 illustrates the air chamber 901 having been attached to the top and bottom layers with the previously-open ends sealed off by an end seal 906 welded to the previously-open ends. The air chamber is attached to the top layer using a weld 907 terminating in a stress-reducing tear drop shape 908. It is noted that keeping the ends of the air chamber outside the edge of the top and bottom layers is advantageous for ease of manufacture and further improves stress reduction at the attachment weld 907. Further, keeping the end seal 906 for the air chamber in the same plane as the top and bottom layer welds 907 is also advantageous with respect to the stress conditions of the system when the air chamber is inflated. Because the weld termination does not have to traverse a curved surface and compress foam, whether inflated or uninflated, the stress on the air chamber is more optimally distributed. It will be appreciated that line 905 in FIG. 10 is merely an illustrative tangent line inserted by the drawing software used to generate the figure.

Figure 11:
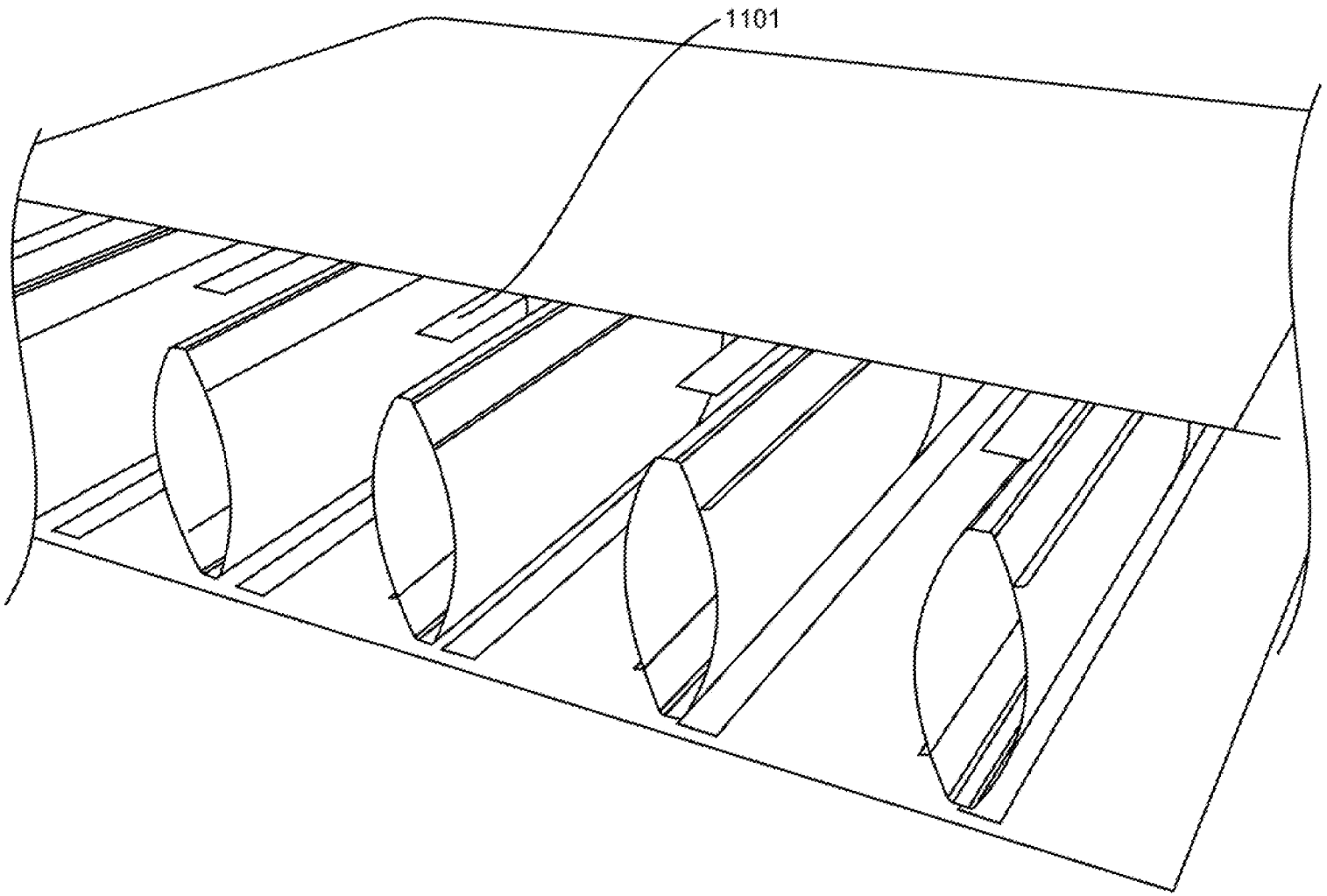
FIGS. 11-12 are schematic diagrams showing views of the components of an exemplary foam-air mattress to illustrate another exemplary welding process.
Figure 12:
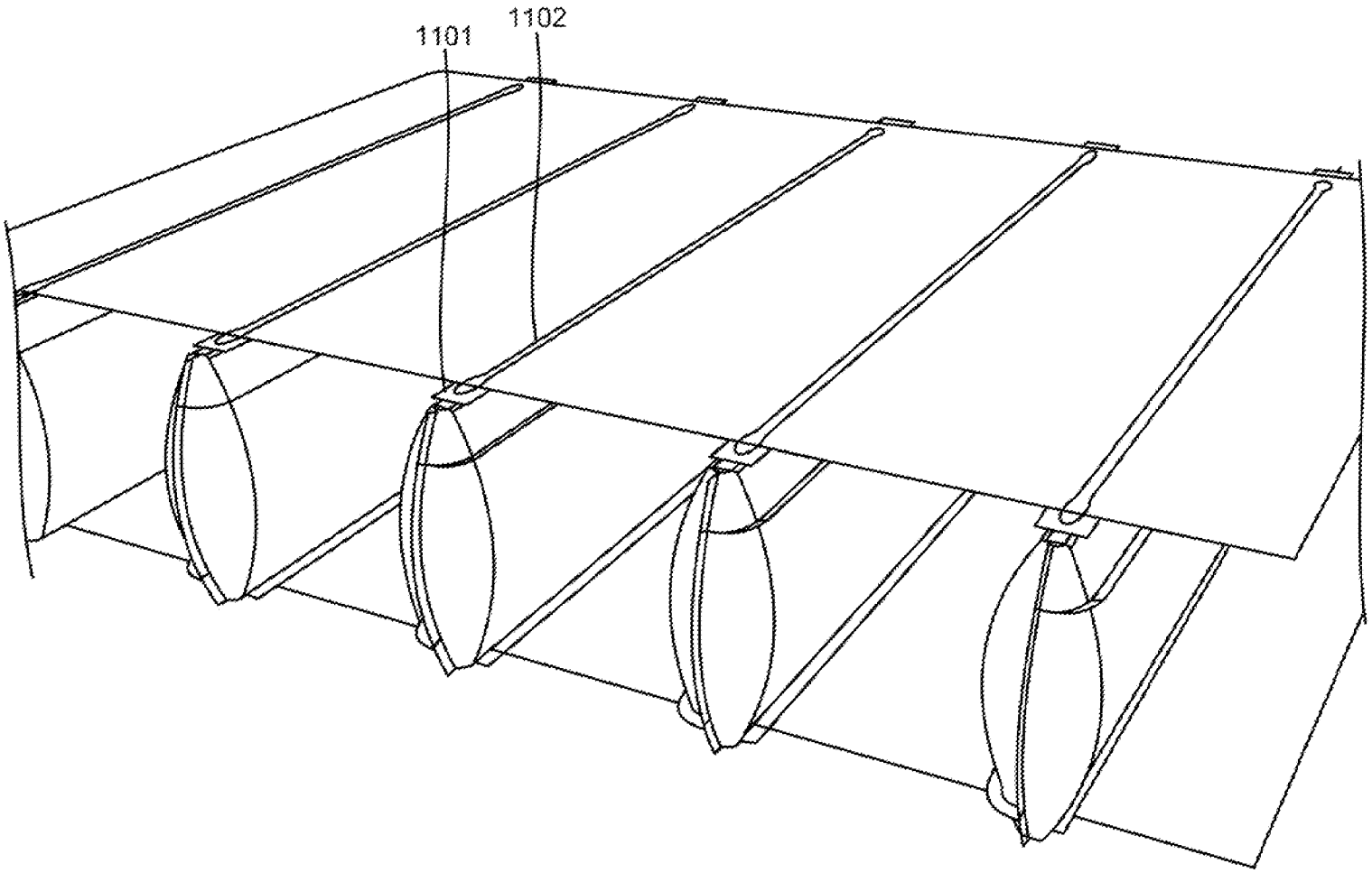

FIGS. 11-12 are schematic diagrams similar to FIGS. 9-10 that illustrate another exemplary welding process where an extra strip of material is used to further support the weld. As shown in FIG. 11, the strip of material 1101 is a thin strip disposed between the air chamber and the top layer (as well as between the air chamber and the bottom layer). In one exemplary embodiment, the strip 1101 is about four times the width of the weld, and it is wider than the top and bottom layers. FIG. 12 depicts the system with the air chamber welded to the top and bottom layers using the strip of material 1101. As can be seen in FIG. 12, the weld 1102 that attaches the top layer to the air chamber goes beyond the edge of the top layer and onto the strip 1101 (but stops before the end of the strip). This configuration allows for additional weld thickness in the high-stress area at the top and bottom of the air chamber where the air chamber is attached to the top and bottom layers, and further spreads the stress experienced in those regions over a larger area. It is noted that the strip 1101 is positioned and sized such that it does not interfere with the end seal of the air chamber.

It is further noted that the foam inserts to be used in foam-air mattress configurations herein should have a density in the range of 0.8-5.0 pounds per cubic foot. It is further noted that the air chambers of the foam-air mattress configurations herein should have a pressure range from 0.0 psi (when uninflated) up to 5.0 psi (when maximally inflated). It would generally not be necessary to use foam inserts that have a density greater than 5.0 pounds per cubic foot and air chamber pressures greater than 5.0 psi in foam-air mattress applications.

It is further noted that the principles described herein are not limited mattress applications, but can be used in other support systems, such as chairs. In one exemplary embodiment, a chair having, for example, a single cushion (with a bend) or two separate cushions, utilizes the principles of the invention to provide an adjustable feeling of firmness for a user of the chair by inflation of air chambers in the seat and/or back cushions of the chair. In the first example, the seat cushion could be designed similarly to the foam-air mattress embodiments discussed above, with a bend in the mattress to provide a seat portion and a back portion. In the second example, separate cushions could be used for the seat and back of the chair, with each cushion being configured similarly to the foam-air mattress embodiments discussed above. The two separate cushions may share a common pump or have their own respective pumps.

It is further noted that the foam-air mattress embodiments (and foam-air chair embodiments) may be adjustable by the user to achieve different levels of firmness, and/or may be adjustable according to routines programmed into a control unit corresponding to a pump. These routines may serve a variety of functions such as massage, pressure relief, circulation improvement, and/or other therapeutic purposes in both consumer and medical contexts.

The use of the terms "a" and "an" and "the" and "at least one" and similar referents in the context of describing the invention are to be construed to cover both the singular and the plural, unless otherwise indicated herein or clearly contradicted by context. The use of any and all examples, or exemplary language (e.g., "such as") provided herein, is intended merely to better illuminate the invention and does not pose a limitation on the scope of the invention.

Figure 13:
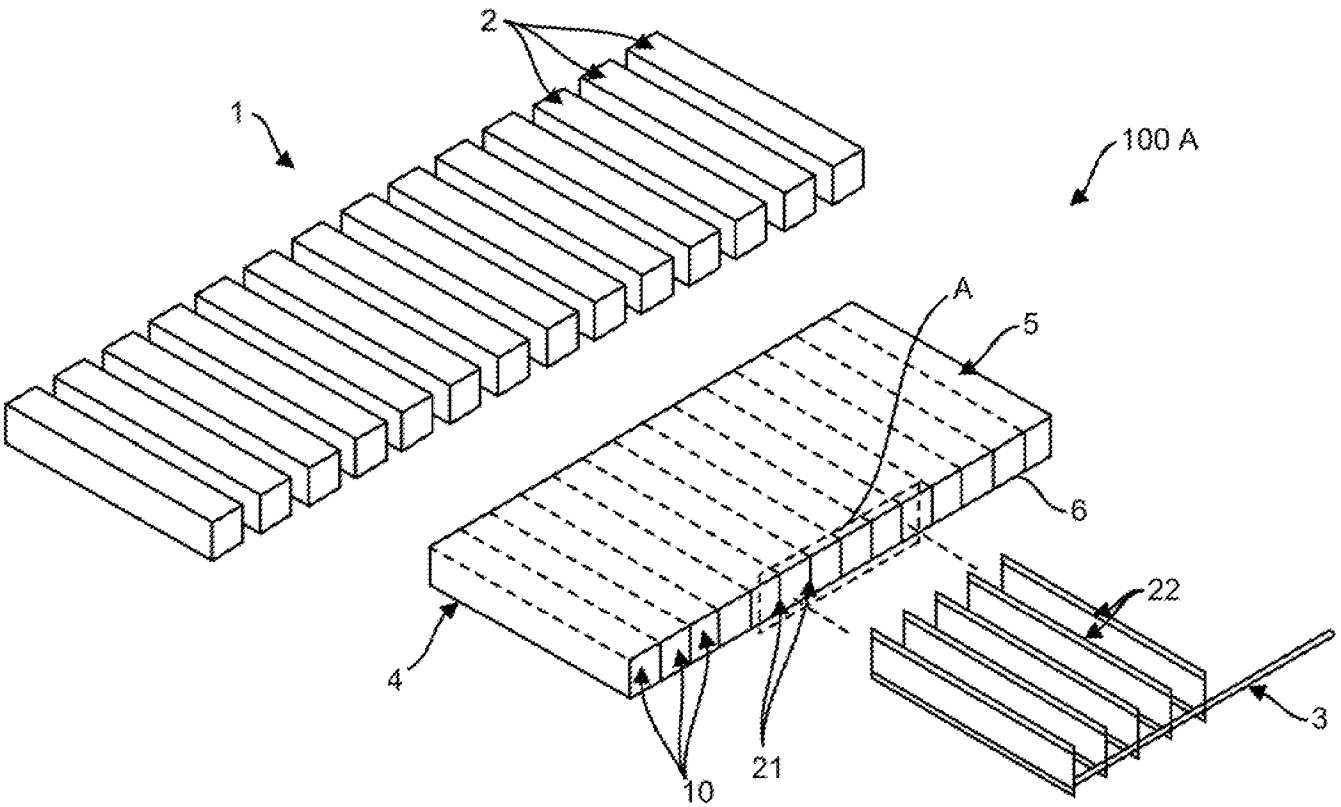
FIG. 13 is a schematic diagram illustrating an expanded view of a portion of a foam-air mattress in another exemplary embodiment.
Figure 14A:
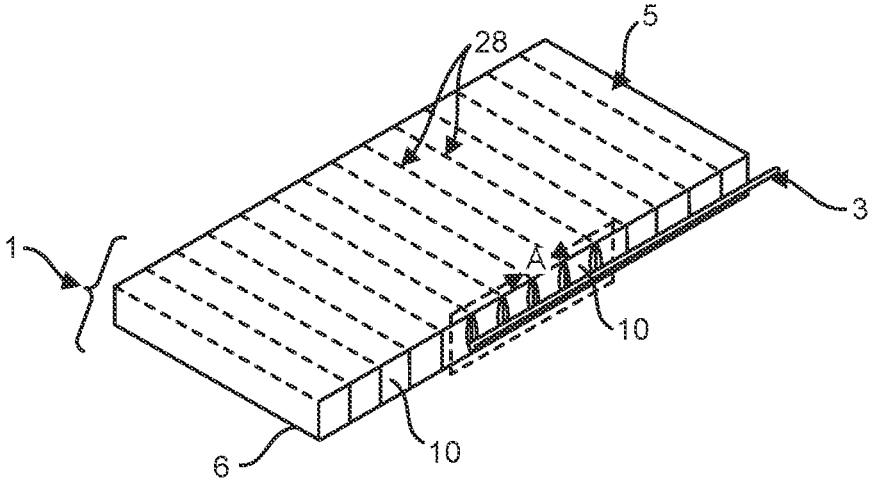
FIG. 14(*a*) is a schematic diagram illustrating a front, partial assembled view of the foam-air mattress depicted in FIG. 13 and illustrating air chambers inserted into air chamber compartments.
Figure 14B:
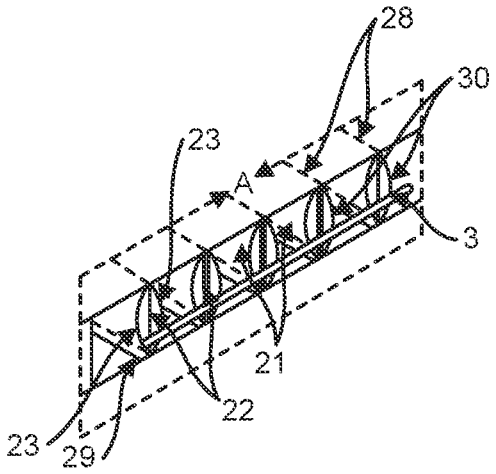
Figure 15A:
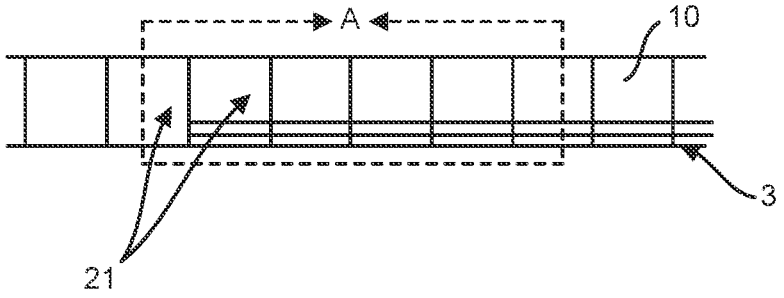
FIG. 15(*a*) is a schematic diagram illustrating a close-up front, assembled view of the foam-air mattress from area A depicted in FIG. 13 in operation with air bladder inserts deflated and pocket walls in a generally juxtaposed position.
Figure 15B:
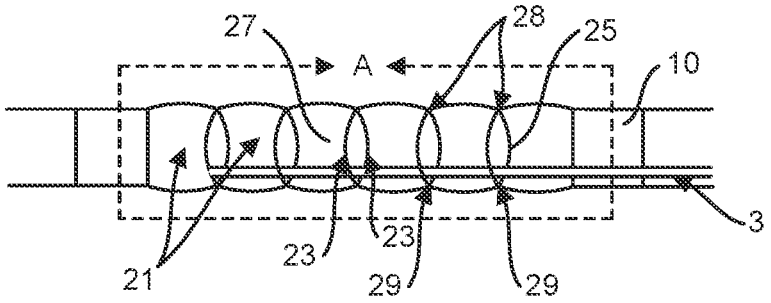

FIGS. 13-15(*b*) are schematic diagrams that illustrate another exemplary embodiment of the airbed system 100A. An expanded view of an adjustable foam-air mattress firmness control module (1) according to an exemplary embodiment of the invention is depicted in FIG. 13. The adjustable foam-air mattress firmness-control module (1) is comprised of several basic parts: a firmness-control housing (4), expandable pocket walls/pocket sidewalls (21) which act as sidewalls for the plurality of foam compartments (10) formed in the firmness control module (1), foam inserts (2) which in this example are rectangular foam logs, and inflatable air chamber (bladder) inserts (22) which are connected to tubing assemblies (3) of a compressed air supply system that connect the inflatable air bladder inserts (22) to the pumping system. (The term "inflatable air bladder inserts" is used interchangeably with "air bladder inserts" throughout this application.)

In one example, the housing (4) of the firmness control module (1) includes a top layer (5), a bottom layer (6), and the expandable pocket walls (21) extending from the top layer to the bottom layer. Woven, flexible fabrics such as spandex are used for the top layer (5) and pocket sidewalls (21) while a non-woven or coated woven fabric is preferred for the bottom layer. Thus, the top layer (5) and sidewalls (21) are able to stretch and flex with adjustments to the firmness of the mattress and as a user changes positions. The bottom layer, which is generally not stretchable, serves as an anchor to maintain the general relative positions of the other module components. In general the materials chosen for the layers are selected from urethane, PVC, coated or uncoated fabric may or may not be capable of holding air, or other suitable materials (e.g., poly-nylon, poly film laminates, rubber construction, etc.). The expandable pocket walls (21) are held in place relative to each other by the top layer (5) and bottom layer (6), for example through sewing, stitching, braiding, or other types of non-air tight attachment. These flexible/stretchable materials and methods of attachment allow the firmness control module housing to substantially, freely flex as the air chambers are inflated or deflated and as a user lies on and moves on the overall mattress. Further, the flexibility of the housing fabric and attachment allow for improved articulation of the mattress by an adjustable base for raising the head and foot of a mattress. This also allows for better control of firmness when a mattress is articulated by an adjustable base.

Each pair of expandable pocket walls (21) is hollow down the center length of the wall pair like a long pocket. The hollow being referred to as an air bladder compartment defined by the pocket walls (21) having an exterior opening (30). The pocket walls (21) are disposed spaced apart in a side-to-side orientation with respect to the mattress housing and each of the pocket walls (21) is substantially parallel to the other pocket walls (21). The pocket walls (21), comprising two opposing side walls (23) connected to each other along a top seam (28) and a bottom seam (29), are configured to accept air bladder inserts (22) through the exterior opening (30) extending between the top seam (28) and bottom seam (29). The air bladder inserts (22) are configured to inflate and deflate, as directed by a user, which as a result configures the pocket wall pairs (21) to expand apart or compress together. The pocket walls (21) are preferably composed of a stretchable or expandable material. In an embodiment, the pocket walls (21) are individually fabricated and then sewn to the top layer (5) along the top seam (28) and bottom layer (6) along the bottom seam (29) of the foam-air mattress (1). The sewn seams (28, 29) keep the pocket walls (21) in place while also allowing for flexibility.

In a further example, air bladder inserts (22) are connected to tubing assemblies (3) in this embodiment. The tubing assemblies (3) comprising a tube or a plurality of tubes. In one embodiment, the air bladder inserts (22) are long and rectangular shaped and are disposed spaced apart in a parallel side-to-side orientation along the length of the tube/plurality of tubes (3). One of the short ends of each rectangular air bladder inserts (22) connect generally, perpendicularly to the tube/plurality of tubes (3) and each extend out away from the tube lengthwise in generally the same direction. Each of the air bladder inserts (22) is sealed and has the capability to receive and hold air. The air bladder inserts (22) are made from an air tight material (e.g. urethane, PVC, coated fabric), allowing the air bladder inserts (22) to hold pressure as it receives air. In one embodiment, the deflated air bladder inserts (22) are slid into the pocket walls (21), and a working fluid (e.g. air) from a pumping system (e.g., as show in in FIG. 1) is pumped into the air bladder inserts (22) inflating the air bladder inserts (22). As the air bladder inserts (22) inflate, the plurality of pocket walls (21) expand and compress the foam inserts (2), thus, changing the density and corresponding firmness feeling associated with the foam. In another embodiment, air need not necessarily be used, as other gases or fluids could be used as well. In another embodiment, the air bladder inserts (22) are disposed spaced apart along the tube/plurality of tubes (3) simultaneously in multiple orientations (e.g. vertical, horizontal, diagonal, etc.).

One exemplary embodiment includes two open ends for the foam-air mattress (depicted in FIG. 13) where the foam inserts (2) can be inserted, the opposite/back side (13) (not pictured), or the front side. Thus, the foam inserts (2) are encapsulated on four sides (e.g., two pocket sidewalls, and the top and bottom layers of the mattress housing), and can be longer than the width of the firmness control housing so as to extend outwards on both sides. In another embodiment, there is a cover wall that is inserted on the air bladder inserts (22) side and it is inserted over the air bladder inserts (22) and tubing assembly (3) once the air bladder inserts (22) have been inserted into the plurality of pocket walls (21).

FIGS. 14(*a*) and 14(*b*) depict the same foam-air mattress in assembled views from different zoom distances. In the depicted embodiment, elastic or stretchable material is used to attach the expandable pocket walls (21) to the top (5) and bottom (6) layers of the mattress housing. The elastic material is sewn, stitched, braided, or the like, to the expandable pocket walls (21) and to the top (5) and bottom (6) layers of the mattress housing along the top seam (28) and bottom seam (29) respectively. In another embodiment, the elastic material is made from polyurethane material or other suitable materials.

FIG. 15(*a*) illustrates the same assembled foam-air mattress with the air bladder inserts (22) deflated and thus, the pocket walls (21) pressed together into a generally juxtaposed position by the foam inserts. FIG. 15(*b*) illustrates the assembled foam-air mattress with the air bladder inserts (22) inflated and thus, the pocket walls (21) are forced apart. Increasing the pressure inside the air bladder inserts (22) increases their volume and forces the pocket walls (21) apart, which because the pocket walls (21) are restrained by sewing stiches between the top (5) and bottom (6) layers of the firmness control housing, reduces the volume of compartments (10) between them, thus compressing the foam inserts (2) and increasing the density of the foam. Because the air bladder expands greater in their central region (25), a compression profile is created in the foam inserts. Specifically, the foam density is increased the most in the center area (27) and less toward the top and bottom; therefore, the increasing firmness of the mattress foam is felt more as additional user weight is applied to the mattress.

In one example, the air bladder inserts (22) have all been inflated to a uniform pressure. In an alternate embodiment the air chambers can be segregated into individual zones each chamber having a different pressure. Alternatively, various air chambers can be grouped together in desired numbers to adjust the firmness of the mattress in an area/zone such as an area corresponding to a user's hips or shoulders.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A foam-air mattress, comprising:

a mattress housing, comprising a top layer and a bottom layer;

a plurality of pocket walls, disposed between the top layer and the bottom layer, wherein each of the plurality of pocket walls comprise two opposing side walls connected to each other along a top seam and a bottom seam;

a plurality of foam compartments formed between the plurality of pocket walls and the top and bottom layers of the mattress housing, wherein the plurality of foam compartments are configured to receive foam inserts, wherein the plurality of pocket walls are sidewalls of the plurality of foam compartments;

a hollow air bladder compartment running along the length of each of the pocket walls in the plurality of pocket walls, the hollow air bladder compartment comprising an exterior opening extending between the top seam and the bottom seam;

inflatable air bladder inserts configured to insert inside the hollow air bladder compartments in the plurality of pocket walls through the exterior opening; and an air supply system comprised of a tubing assembly in communication with the inflatable air chamber inserts and configured to supply compressed air to the air chamber inserts.

2. The foam-air mattress of claim 1, wherein the plurality of foam compartments each have one or more open ends, wherein the foam inserts are insertable and removable via the open ends of the foam compartments.

3. The foam-air mattress of claim 2, wherein the plurality of pocket walls are configured to expand and compress by inflating the air bladder inserts that are inserted inside the hollow air bladder compartments of the plurality of pocket walls.

4. The foam-air mattress of claim 3, wherein the expansion or compression of the pocket walls compresses the foam inserts disposed within the plurality of foam compartments, increasing the density of the foam inserts.

5. The foam-air support system of claim 1, wherein each of the pocket walls is disposed in a side-to-side orientation with respect to the mattress housing and each of the pocket walls is substantially parallel to the other pocket walls.

6. The foam-air mattress of claim 1, wherein the tubing assembly comprises a plurality of tubes, each of the plurality of tubes being connected to the air bladder inserts which are then slid into each of the hollow air bladder compartments in each of the plurality of pocket walls.

7. The foam-air mattress of claim 6, wherein the air bladder inserts are grouped into zones such that air bladder inserts corresponding to a particular zone are configured with the capability to be simultaneously inflated or deflated independent from air bladder inserts of a different zone.

8. The foam-air mattress of claim 6, wherein each of the air bladder inserts is disposed in a side-to-side orientation with respect to the mattress housing and each of the air bladder inserts is substantially parallel to the other air bladder inserts.

9. The foam-air mattress of claim 6, wherein a first group of air bladder inserts are disposed in a first orientation with respect to the mattress housing, and a second group of air bladder inserts are disposed in a second orientation with respect to the mattress housing different from the first orientation.

10. The foam-air mattress of claim 1, wherein top layer of the mattress housing is substantially flat when the air bladder inserts are inserted into the plurality of pocket walls and inflated.

11. The foam-air mattress of claim 1, wherein each of the plurality of foam compartments includes a first wall formed by a first pocket wall, a second wall formed by a second pocket wall, a third wall formed by the top layer of the mattress housing, and a fourth wall formed by the bottom layer of the mattress housing.

12. The foam-air mattress of claim 1, wherein the bottom layer and the top layer of the mattress housing include one or more air chambers, wherein the one or more air chambers in the top and bottom layers, when inflated, are configured to compress foam inserts disposed within the plurality of foam compartments, increasing the density of the foam inserts.

13. The foam-air mattress of claim 1, wherein elastic material is used to connect the plurality of pocket walls to the top and bottom layers of the mattress housing.

14. The foam-air mattress of claim 13 wherein the elastic material is braided.

15. The foam-air mattress of claim 13 wherein the elastic material is connected to the plurality of pocket walls and to the top and bottom layers of the mattress by sewing or stitching the elastic material to the plurality of pocket walls and to the top and bottom layers of the mattress.

16. The foam-air mattress of claim 13, wherein the elastic material is a polyurethane material.

17. The foam-air mattress of claim 1, wherein a cover is configured to be placed on the air bladder insert side, over the air bladder inserts and tubing assembly once the air bladder inserts have been inserted into the plurality of pocket walls.

18. A foam-air support system, comprising:

a first layer and a second layer of a support housing;

a plurality of pocket walls disposed as sidewalls between the first layer and the second layer, wherein each of the plurality of pocket walls comprise two opposing side walls connected to each other along a top seam and a bottom seam, wherein the plurality of pocket walls are configured with a hollow air bladder compartment running down the length of each of the pocket walls in the plurality of pocket walls, the hollow air bladder compartment comprising an exterior opening extending between the top seam and the bottom seam, the plurality of pocket walls being arranged so as to form a plurality of foam compartments, each of the plurality of foam compartments being encapsulated in part by at least one pocket wall of the plurality of pocket walls;

a plurality of foam inserts configured to insert within the plurality of foam compartments;

inflatable air bladder inserts configured to insert inside the air bladder compartments in the plurality of pocket walls through the exterior opening; and a tubing assembly configured to connect the air bladder inserts to an air pumping system;

wherein the plurality of pocket walls and the plurality of foam inserts are configured such that inflation of the air bladder inserts while inserted in the plurality of pocket walls, configures the plurality of pockets walls to expand, compressing adjacent foam inserts and increasing the density of said foam inserts.

19. The foam-air support system of claim 18, wherein the plurality of foam compartments each have one or more open ends, and wherein the foam inserts are configured to be inserted and removed via the open ends of the foam compartments.

20. The foam-air support system of claim 18, wherein each of the pocket walls are disposed in a side-to-side orientation with respect to the mattress housing and each of the pocket walls are substantially parallel to the other pocket walls.

21. The foam-air support system of claim 18, wherein the tubing assembly comprises a plurality of tubes connected to the air bladder inserts, wherein the air bladder inserts are configured to each slide into one of the plurality of pocket walls.

22. The foam-air support system of claim 21, wherein the air bladder inserts are grouped into zones such that the pocket walls with air bladder inserts corresponding to a particular zone are configured with the capability to simultaneously inflate or deflate independent from the pocket walls with air bladder inserts of a different zone.

23. The foam-air support system of claim 21, wherein each of the air bladder inserts are disposed in a side-to-side orientation within each of the pocket walls with respect to the mattress housing and each of the air bladder inserts within each of the pocket walls are substantially parallel to the other air bladder inserts within the other pocket walls.

24. The foam-air support system of claim 18, wherein a first group of pocket walls are disposed in a first orientation with respect to the support housing, and a second group of pocket walls are disposed in a second orientation with respect to the support housing different from the first orientation.

25. The foam-air support system of claim 18, wherein the first layer is a top layer of the support housing, and the first layer is substantially flat when the plurality of pocket walls are inflated.

26. The foam-air support system of claim 18, wherein a particular compartment of the plurality of foam compartments is encapsulated by a first wall formed by a first pocket wall, a second wall formed by a second pocket wall, a third wall formed by the first layer of the support housing, and a fourth wall formed by the second layer of the support housing.

27. The foam-air support system of claim 18, wherein the first layer and the second layer of the support housing include one or more additional pocket walls, wherein the one or more additional pocket walls, when inflated by the pumping system, are configured expand, compressing the foam insert and increasing the density of the foam insert.

28. The foam-air support system of claim 18, wherein elastic material is used to connect the plurality of pocket walls to the top and bottom layers of the support housing.

29. The foam-air mattress of claim 28 wherein the elastic material is braided.

30. The foam-air mattress of claim 28, wherein the elastic material is connected to the plurality of pocket walls and to the top and bottom layers of the mattress by sewing or stitching the elastic material to the plurality of pocket walls and to the top and bottom layers of the mattress.

* * * * *